US010845142B2

(12) United States Patent
Flood

(10) Patent No.: US 10,845,142 B2
(45) Date of Patent: Nov. 24, 2020

(54) METHODS, SYSTEMS, APPARATUSES AND DEVICES FOR FACILITATING COUNTING AND DISPLAYING OF AN AMMUNITION COUNT OF A MAGAZINE OF A FIREARM

(71) Applicant: Victor Flood, Birmingham, AL (US)

(72) Inventor: Victor Flood, Birmingham, AL (US)

( * ) Notice: Subject to any disclaimer, the term of this patent is extended or adjusted under 35 U.S.C. 154(b) by 0 days.

(21) Appl. No.: 16/453,407

(22) Filed: Jun. 26, 2019

(65) Prior Publication Data

US 2020/0080807 A1 Mar. 12, 2020

Related U.S. Application Data

(60) Provisional application No. 62/693,096, filed on Jul. 2, 2018.

(51) Int. Cl.
*F41A 9/62* (2006.01)

(52) U.S. Cl.
CPC ..... *F41A 9/62* (2013.01)

(58) Field of Classification Search
CPC ..... F41A 9/62
USPC ..... 42/1.02
See application file for complete search history.

(56) References Cited

U.S. PATENT DOCUMENTS 5,005,307 A * 4/1991 Horne ..... F41A 9/62 42/1.02
5,052,138 A * 10/1991 Crain ..... F41A 9/62 42/1.02
5,142,805 A * 9/1992 Horne ..... F41A 9/62 42/1.02
5,406,730 A * 4/1995 Sayre ..... F41A 9/62 42/1.02
5,577,962 A * 11/1996 Kounoe ..... A63F 9/0291 463/49
5,642,581 A * 7/1997 Herold ..... F41A 9/62 42/1.02
5,799,432 A * 9/1998 Wright, Sr. ..... F41A 9/62 42/1.02
5,826,360 A * 10/1998 Herold ..... F41A 9/62 42/1.02
8,770,978 B2 * 7/2014 Botten ..... F41A 33/04 434/16
9,212,857 B2 12/2015 Loreman
10,018,438 B2 * 7/2018 Biran ..... F41A 17/36
2008/0276517 A1 * 11/2008 Delgado Acarreta ..... F41A 9/62 42/1.02
2010/0281725 A1 * 11/2010 Arbouw ..... F41A 9/62 42/1.02

(Continued)

*Primary Examiner* — Joshua E Freeman

(57) ABSTRACT

Disclosed herein is a system to facilitate counting and displaying of an ammunition count of a magazine of a firearm. Further, the system may include a sensory device configured to generate a sensory data related to a movement of ammunition in the magazine. Further, the system may include a processing device communicatively connected with the sensory device configured for analyzing the sensory data to generate an ammunition data. Further, the ammunition data may include a number of ammunition rounds in the magazine. Further, the system may include a presentation device communicatively connected with the processing device configured for displaying the ammunition data. Further, the system may include a storage device configured for storing the ammunition data.

18 Claims, 16 Drawing Sheets

(56) References Cited

U.S. PATENT DOCUMENTS

| | | | | |
|---|---|---|---|---|
| 2012/0167423 | A1* | 7/2012 | Kindt | G01G 19/52 42/1.02 |
| 2015/0113847 | A1* | 4/2015 | Acarreta | F41A 19/01 42/1.01 |
| 2016/0069629 | A1* | 3/2016 | Seckman | F41A 9/62 42/1.02 |
| 2016/0109206 | A1* | 4/2016 | Beckman | F42B 5/285 434/16 |
| 2016/0169602 | A1* | 6/2016 | Demierre | F41A 9/62 42/1.02 |
| 2016/0252317 | A1* | 9/2016 | Biran | F41A 17/38 42/1.01 |
| 2017/0146309 | A1* | 5/2017 | Biran | F41A 17/38 |
| 2017/0146310 | A1* | 5/2017 | Biran | F41C 3/00 |
| 2017/0321987 | A1* | 11/2017 | Apkarian | F24F 11/58 |
| 2017/0336160 | A1* | 11/2017 | Walther | B32B 15/20 |
| 2018/0172377 | A1* | 6/2018 | Keys | F41A 9/62 |
| 2018/0372436 | A1* | 12/2018 | Biran | F41A 17/34 |
| 2019/0063865 | A1* | 2/2019 | Victor | F41A 9/66 |
| 2019/0277590 | A1* | 9/2019 | Masarik | F41A 9/70 |

* cited by examiner

METHODS, SYSTEMS, APPARATUSES AND DEVICES FOR FACILITATING COUNTING AND DISPLAYING OF AN AMMUNITION COUNT OF A MAGAZINE OF A FIREARM

The current application claims a priority to the U.S. Provisional Patent application Ser. No. 62/693,096 filed on Jul. 1, 2014.

TECHNICAL FIELD

Generally, the present disclosure relates to the field of firearms. More specifically, the present disclosure relates to methods, systems, apparatuses and devices for facilitating counting and displaying of an ammunition count of a magazine of a firearm.

BACKGROUND OF THE INVENTION

Generally, individuals using a firearm are unable to accurately determine the number of ammunition remaining in the magazine of a firearm. Further, firearms users such as law enforcement officers or soldiers may need to know the exact amount of ammunition remaining in the firearm. Moreover, the users may need to know if the ammunition remaining in the magazine of the firearm is below a predetermined level after which reloading the firearm may be required.

Further, fully automatic firearms such as a machine gun may utilize much more ammunition to neutralize a potential target than required. Moreover, not knowing the precise number of live ammunition in a firearm may result in events such as accidental shootings.

Further, tracking the origin of a firearm or components of the firearm such as a magazine involved in a criminal activity may be difficult. Moreover, verification of users using firearms in the vicinity of an educational institution, such as a school or university is not performed that may result in events such as school shooting.

Therefore, there is a need for improved methods, systems, apparatuses and devices for facilitating counting and displaying of an ammunition count of a magazine of a firearm that may overcome one or more of the above-mentioned problems and/or limitations.

BRIEF SUMMARY

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is a system to facilitate counting and displaying of an ammunition count of a magazine of a firearm. Further, the system may include a sensory device configured to generate a sensory data related to a movement of ammunition in the magazine. Further, the system may include a processing device communicatively connected with the sensory device configured for analyzing the sensory data to generate an ammunition data. Further, the ammunition data may include a number of ammunition rounds in the magazine. Further, the system may include a presentation device communicatively connected with the processing device configured for displaying the ammunition data. Further, the system may include a storage device configured for storing the ammunition data.

Further disclosed herein is a magazine of a firearm configured for counting and displaying of an ammunition count of the magazine. Further, the magazine may include a sensory device configured to generate a sensory data related to at least one of a movement of ammunition in the magazine, and a movement of the ammunition from the magazine to a firing chamber of the firearm. Further, the magazine may include a processing device communicatively connected with the sensory device configured for analyzing the sensory data to generate an ammunition data. Further, the ammunition data may include a number of ammunition rounds in the magazine. Further, the magazine may include a presentation device communicatively connected with the processing device configured for displaying the ammunition data. Further, the magazine may include a storage device configured for storing the ammunition data.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Figure 1:
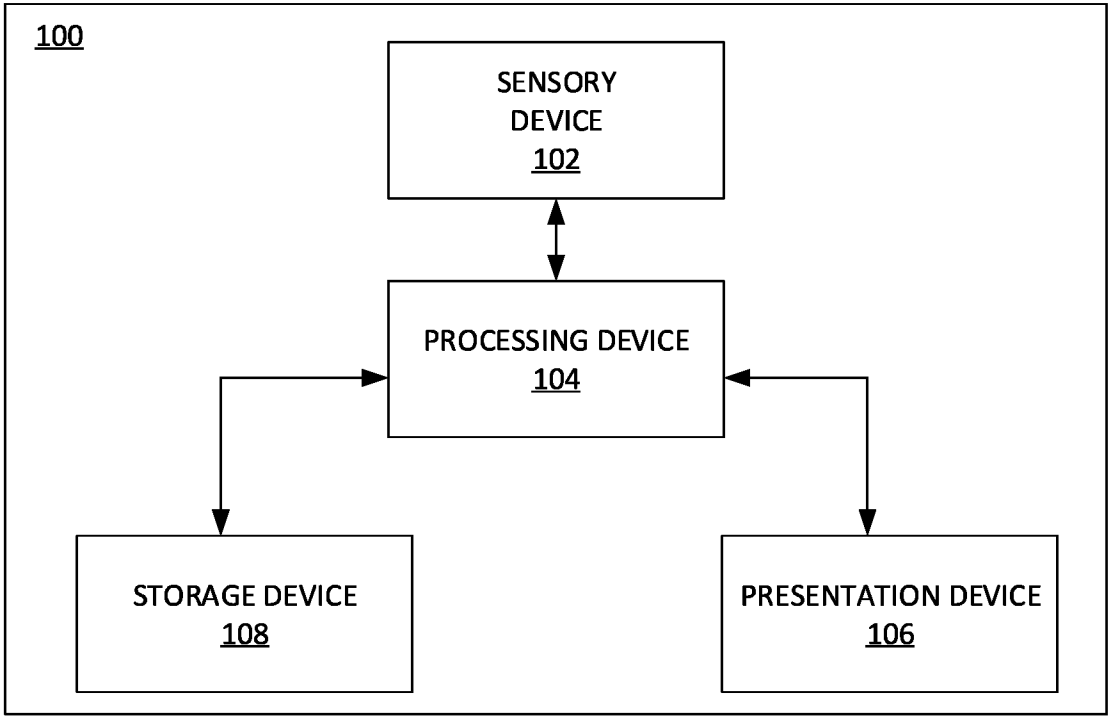
FIG. 1 is a block diagram of a system to facilitate counting and displaying of an ammunition count of a magazine of a firearm, in accordance with some embodiments.

Furthermore, the drawings may contain text or captions that may explain certain embodiments of the present disclosure. This text is included for illustrative, non-limiting, explanatory purposes of certain embodiments detailed in the present disclosure.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of counting and displaying of an ammunition count of a magazine of a firearm, embodiments of the present disclosure are not limited to use only in this context.

In general, the method disclosed herein may be performed by one or more computing devices. For example, in some embodiments, the method may be performed by a server computer in communication with one or more client devices over a communication network such as, for example, the Internet. In some other embodiments, the method may be performed by one or more of at least one server computer, at least one client device, at least one network device, at least one sensor and at least one actuator. Examples of the one or more client devices and/or the server computer may include, a desktop computer, a laptop computer, a tablet computer, a personal digital assistant, a portable electronic device, a wearable computer, a smart phone, an Internet of Things (IoT) device, a smart electrical appliance, a video game console, a rack server, a super-computer, a mainframe computer, mini-computer, micro-computer, a storage server, an application server (e.g. a mail server, a web server, a real-time communication server, an FTP server, a virtual server, a proxy server, a DNS server etc.), a quantum computer, and so on. Further, one or more client devices and/or the server computer may be configured for executing a software application such as, for example, but not limited to, an operating system (e.g. Windows, Mac OS, Unix, Linux, Android, etc.) in order to provide a user interface (e.g. GUI, touch-screen based interface, voice based interface, gesture based interface etc.) for use by the one or more users and/or a network interface for communicating with other devices over a communication network. Accordingly, the server computer may include a processing device configured for performing data processing tasks such as, for example, but not limited to, analyzing, identifying, determining, generating, transforming, calculating, computing, compressing, decompressing, encrypting, decrypting, scrambling, splitting, merging, interpolating, extrapolating, redacting, anonymizing, encoding and decoding. Further, the server computer may include a communication device configured for communicating with one or more external devices. The one or more external devices may include, for example, but are not limited to, a client device, a third party database, public database, a private database and so on. Further, the communication device may be configured for communicating with the one or more external devices over one or more communication channels. Further, the one or more communication channels may include a wireless communication channel and/or a wired communication channel. Accordingly, the communication device may be configured for performing one or more of transmitting and receiving of information in electronic form. Further, the server computer may include a storage device configured for performing data storage and/or data retrieval operations. In general, the storage device may be configured for providing reliable storage of digital information. Accordingly, in some embodiments, the storage device may be based on technologies such as, but not limited to, data compression, data backup, data redundancy, deduplication, error correction, data fingerprinting, role based access control, and so on.

Further, one or more steps of the method disclosed herein may be initiated, maintained, controlled and/or terminated based on a control input received from one or more devices operated by one or more users such as, for example, but not limited to, an end user, an admin, a service provider, a service consumer, an agent, a broker and a representative thereof. Further, the user as defined herein may refer to a human, an animal or an artificially intelligent being in any state of existence, unless stated otherwise, elsewhere in the present disclosure. Further, in some embodiments, the one or more users may be required to successfully perform authentication in order for the control input to be effective. In general, a user of the one or more users may perform authentication based on the possession of a secret human readable secret data (e.g. username, password, passphrase, PIN, secret question, secret answer etc.) and/or possession of a machine readable secret data (e.g. encryption key, decryption key, bar codes, etc.) and/or or possession of one or more embodied characteristics unique to the user (e.g. biometric variables such as, but not limited to, fingerprint, palm-print, voice characteristics, behavioral characteristics, facial features, iris pattern, heart rate variability, evoked potentials, brain waves, and so on) and/or possession of a unique device (e.g. a device with a unique physical and/or chemical and/or biological characteristic, a hardware device with a unique serial number, a network device with a unique IP/MAC address, a telephone with a unique phone number, a smartcard with an authentication token stored thereupon, etc.). Accordingly, the one or more steps of the method may include communicating (e.g. transmitting and/or receiving) with one or more sensor devices and/or one or more actuators in order to perform authentication. For example, the one or more steps may include receiving, using the communication device, the secret human readable data from an input device such as, for example, a keyboard, a keypad, a touch-screen, a microphone, a camera and so on. Likewise, the one or more steps may include receiving, using the communication device, the one or more embodied characteristics from one or more biometric sensors.

Further, one or more steps of the method may be automatically initiated, maintained and/or terminated based on one or more predefined conditions. In an instance, the one or more predefined conditions may be based on one or more contextual variables. In general, the one or more contextual variables may represent a condition relevant to the performance of the one or more steps of the method. The one or more contextual variables may include, for example, but are not limited to, location, time, identity of a user associated with a device (e.g. the server computer, a client device etc.) corresponding to the performance of the one or more steps, environmental variables (e.g. temperature, humidity, pressure, wind speed, lighting, sound, etc.) associated with a device corresponding to the performance of the one or more steps, physical state and/or physiological state and/or psychological state of the user, physical state (e.g. motion, direction of motion, orientation, speed, velocity, acceleration, trajectory, etc.) of the device corresponding to the performance of the one or more steps and/or semantic content of data associated with the one or more users. Accordingly, the one or more steps may include communicating with one or more sensors and/or one or more actuators associated with the one or more contextual variables. For example, the one or more sensors may include, but are not limited to, a timing device (e.g. a real-time clock), a location sensor (e.g. a GPS receiver, a GLONASS receiver, an indoor location sensor etc.), a biometric sensor (e.g. a fingerprint sensor), an environmental variable sensor (e.g. temperature sensor, humidity sensor, pressure sensor, etc.) and a device state sensor (e.g. a power sensor, a voltage/current sensor, a switch-state sensor, a usage sensor, etc. associated with the device corresponding to performance of the or more steps).

Further, the one or more steps of the method may be performed one or more number of times. Additionally, the one or more steps may be performed in any order other than as exemplarily disclosed herein, unless explicitly stated otherwise, elsewhere in the present disclosure. Further, two or more steps of the one or more steps may, in some embodiments, be simultaneously performed, at least in part. Further, in some embodiments, there may be one or more time gaps between performance of any two steps of the one or more steps.

Further, in some embodiments, the one or more predefined conditions may be specified by the one or more users. Accordingly, the one or more steps may include receiving, using the communication device, the one or more predefined conditions from one or more and devices operated by the one or more users. Further, the one or more predefined conditions may be stored in the storage device. Alternatively, and/or additionally, in some embodiments, the one or more predefined conditions may be automatically determined, using the processing device, based on historical data corresponding to performance of the one or more steps. For example, the historical data may be collected, using the storage device, from a plurality of instances of performance of the method. Such historical data may include performance actions (e.g. initiating, maintaining, interrupting, terminating, etc.) of the one or more steps and/or the one or more contextual variables associated therewith. Further, machine learning may be performed on the historical data in order to determine the one or more predefined conditions. For instance, machine learning on the historical data may determine a correlation between one or more contextual variables and performance of the one or more steps of the method. Accordingly, the one or more predefined conditions may be generated, using the processing device, based on the correlation.

Further, one or more steps of the method may be performed at one or more spatial locations. For instance, the method may be performed by a plurality of devices interconnected through a communication network. Accordingly, in an example, one or more steps of the method may be performed by a server computer. Similarly, one or more steps of the method may be performed by a client computer. Likewise, one or more steps of the method may be performed by an intermediate entity such as, for example, a proxy server. For instance, one or more steps of the method may be performed in a distributed fashion across the plurality of devices in order to meet one or more objectives. For example, one objective may be to provide load balancing between two or more devices. Another objective may be to restrict a location of one or more of an input data, an output data and any intermediate data therebetween corresponding to one or more steps of the method. For example, in a client-server environment, sensitive data corresponding to a user may not be allowed to be transmitted to the server computer. Accordingly, one or more steps of the method operating on the sensitive data and/or a derivative thereof may be performed at the client device.

FIG. 1 is a block diagram of a system 100 to facilitate counting and displaying of an ammunition count of a magazine of a firearm, in accordance. Further, the system 100 may include a sensory device 102 configured to generate a sensory data related to a movement of ammunition in the magazine. For instance, the sensory device 102 may include at least one of an infra-red sensor, a photoelectric sensor, an electro-optical sensor, a laser sensor, and so on. Further, the sensory device 102 may be configured for detecting a movement of the ammunition in the magazine. Further, in some embodiments, instance, the sensory device 102, such as the infrared sensor may be positioned at feed lips of the magazine. Further, the sensory data may relate to an insertion of one or more ammunition rounds into the magazine. For instance, the sensory data generated by the infrared sensor may include at least one resistance and/or output voltage reading generated upon insertion of at least one ammunition round into the magazine. Further, the system 100 may include a processing device 104 communicatively connected with the sensory device 102 configured for analyzing the sensory data to generate an ammunition data. Further, the ammunition data may include the number of ammunition rounds in the magazine. For instance, the ammunition data generated by the infrared sensor may be analyzed to indicate the number of ammunition rounds inserted into the magazine. For instance, the ammunition data may indicate that 30 ammunition rounds may have been inserted into the magazine. Further, the system 100 may include a presentation device 106 communicatively connected with the processing device 104, configured for presenting the ammunition data. For instance, the presentation device may include a speaker device configured for presenting the ammunition data, such as number of ammunition rounds as a sound based output. Further, the system 100 may include a storage device 108 communicatively connected to the processing device 104, configured for storing the ammunition data.

Further, in some embodiments, the sensory data may relate to a movement of the ammunition from the magazine to a firing chamber of the firearm. For instance, the sensory data may relate to movement of an ammunition round from the magazine to a firing chamber of the firearm upon loading of the firearm. Further, the ammunition data may include a number of ammunition rounds fired. Accordingly, the number of ammunition rounds remaining in the magazine may be presented using the presentation device 106.

Further, in some embodiments, the processing device 104 may be configured for analyzing the sensory data for generating an ammunition usage data including a usage of one or more rounds of ammunition. Further, the ammunition usage data may include (but may not limited to) a rate of fire, a number of ammunition rounds fired in a period, such as a day, a week, a month, a year, and so on. For instance, the ammunition usage data may indicate that a user of the firearm may have fired 25 ammunition rounds in an hour. Further, the ammunition usage data may include an indication of a typical firing behavior of the user of the firearm. For instance, the typical firing behavior of the user may include that the user of the firearm may fire in short bursts, such as in bursts of 3 ammunition rounds.

Further, in some embodiments, the sensory device 102 may include a location sensor. Further, the sensory data may include a location data. Further, the processing device 104 may be configured for generating the ammunition usage data based on the location data. Further, the storage device 108 may be configured for storing the ammunition usage data along with the location data.

For instance, the sensory device 102 may include a Global Positioning System (GPS) tracker. Further, the sensory data generated by the GPS tracker may include a location data and a time data at which a shot is fired from the firearm. Further, in an instance, one or more visualizations may be generated based on the location data and the ammunition data. For instance, one or more heat maps of one or more locations where the user of the firearm may have fired the ammunition rounds may be generated. Moreover, the location data and a time at which the one or more ammunition rounds may be stored in the storage device 106.

Figure 2:
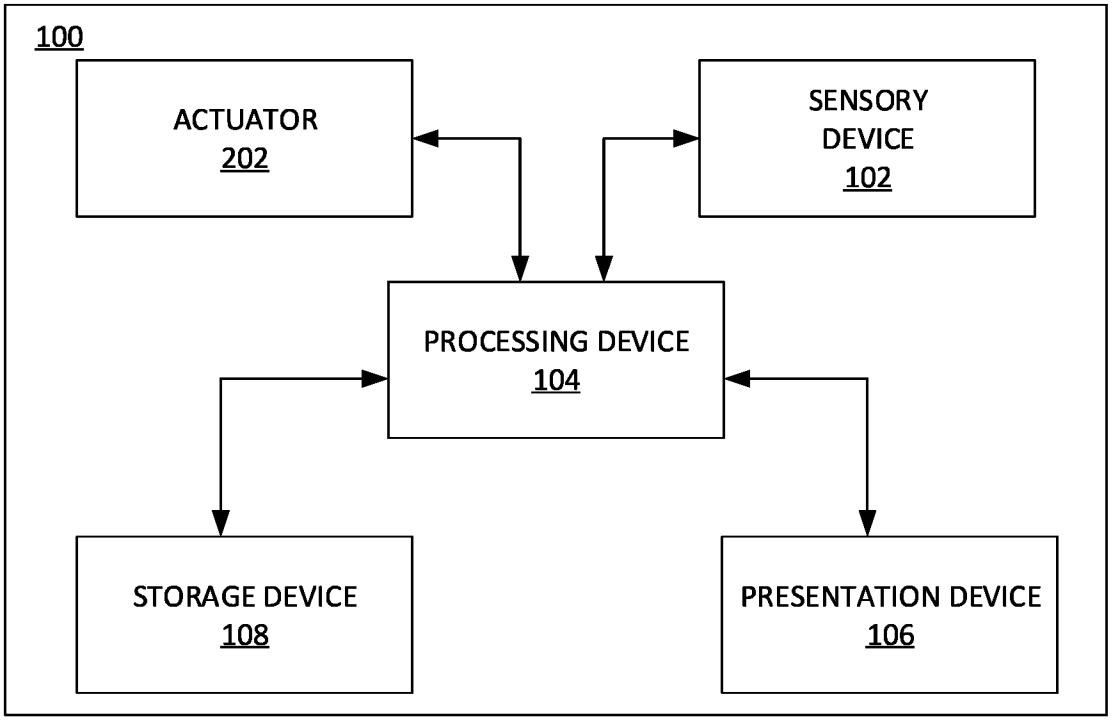
FIG. 2 is a block diagram of a system to facilitate counting and displaying of an ammunition count of a magazine of a firearm, including an actuator, in accordance with some embodiments.

Further, in some embodiments, as shown in FIG. 2, the system 100 may include at least one actuator 202 configured to interact with a firing mechanism of the firearm. Further, the processing device 104 may be configured for generating an actuating signal based on the location data. Further, the at least one actuator 202 may be configured to control the firing mechanism of the firearm based on the actuating signal.

In some embodiments, the firing mechanism of the firearm may be disabled if the location data indicates that the firearm is located in an unauthorized shooting zone. For instance, the location data, and an authorization of the user of the firearm may be analysed by the processing device 104. For instance, if the user is determined to be authorized corresponding to the location of the user, the firing mechanism of the firearm may not be disabled. Alternately, if the user is determined to be unauthorized corresponding to the location of the user, the firing mechanism of the firearm may be disabled. For example, if the user is a civilian, the firing mechanism of the firearm may be disabled in the vicinity of an educational institution, such as a school or university. However, if the user is authorized personnel, such as a security guard, or a police detective, the firing mechanism of the firearm may not be disabled.

Further, in some embodiments, the processing device 104 may be configured for updating the ammunition data based on the sensory data. Further, the presentation device 106 may be configured for presenting the ammunition data based on the updating. For instance, the updating the ammunition data may include reducing the number of ammunition rounds. Further, the presentation device 106 may be configured for presenting the reduced number of ammunition rounds. For instance, if the magazine corresponds to a shotgun, and includes 5 ammunition rounds, and if the user fires 2 ammunition rounds, the presentation device 106 may be configured for presenting the reduced number of ammunition rounds as 3.

Further, in some embodiments, the presentation device 106 may include a digital display device configured to display the ammunition data. For instance, if the magazine corresponds to a shotgun, and includes 5 ammunition rounds, the display device may be configured for displaying the number 5 corresponding to the number of ammunition rounds.

Further, in some embodiments, the system 100 may include an input mechanism configured for receiving a user input corresponding to a desired ammunition data. Further, the processing device 104 may be configured for updating the desired ammunition data based on the sensory data to generate an updated ammunition data. Further, the presentation device 106 may be configured for presenting each of the desired ammunition data and the updated ammunition data respectively. For instance, the desired ammunition data may include a number of ammunition rounds that the user of the firearm may wish to use to neutralize a target. For instance, the input mechanism may include at least one button configured to be manipulated by the user for receiving the desired ammunition data. Further, the desired ammunition data may include a number 7 corresponding to 7 ammunition rounds that the user may wish to use to neutralize a target. Further, the presentation device 106 may be configured for presenting the desired ammunition data. Further, the processing device 104 may be configured for generating the updated ammunition data based on the sensory data, such as indicating one or more ammunition rounds fired by the user. For instance, if the desired ammunition data includes the number 7 corresponding to 7 ammunition rounds that the user wishes to use to neutralize a target, and the user fires 4 ammunition rounds to neutralize the target, the updated ammunition data generated based on the sensory data may include the number 3 corresponding to 3 remaining ammunition rounds out of 7. Further, the presentation device 106 may be configured for presenting the updated ammunition data.

Further, in some embodiments, the processing device 104 may be configured for generating an actuating signal corresponding to the at least one actuator 202 based on each of the desired ammunition data and the updated ammunition data. Further, the at least one actuator 202 may be configured to control the firing mechanism of the firearm based on the actuating signal. For instance, if the desired ammunition data includes the number 7 corresponding to 7 ammunition rounds that the user wishes to use to neutralize a target, and the user fires 4 ammunition rounds to neutralize the target, the updated ammunition data generated based on the sensory data may include the number 3 corresponding to 3 remaining ammunition rounds out of 7. Further, the user may fire the presentation device 106 may be configured for presenting the updated ammunition data. Further, the user may fire the remaining ammunition rounds, and the processing device may be configured for generating the updated ammunition data corresponding to the firing of 3 the remaining ammunition rounds. Further, the updated ammunition data may include an indication that the number of remaining ammunition rounds in relation to the desired ammunition data may be 0. Accordingly, the processing device 104 may be configured for generating an actuating signal based on the updated ammunition data. Further, the at least one actuator 202 may be configured to control the firing mechanism of the firearm based on the actuating signal and disable the firing mechanism of the firearm.

Figure 3:
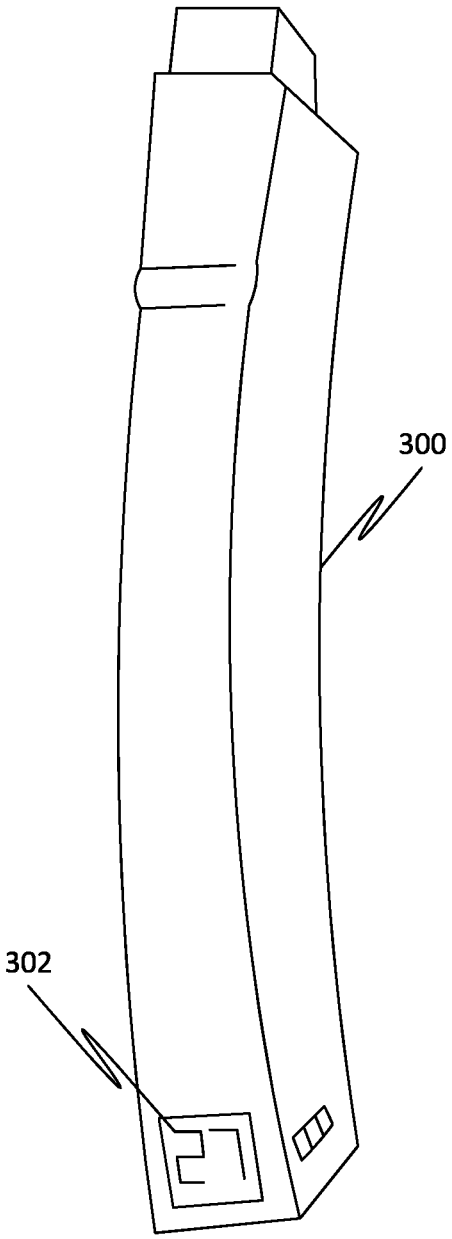
FIG. 3 is a magazine of a firearm configured for counting and displaying of an ammunition count of the magazine, in accordance with some embodiments.

FIG. 3 is a magazine 300 of a firearm configured for counting and displaying of an ammunition count of the magazine 300. Further, the magazine 300 may include a sensory device (not shown), such as the sensory device 102, configured to generate a sensory data related to at least one of a movement of ammunition in the magazine 300, and a movement of the ammunition from the magazine 300 to a firing chamber of the firearm.

Further, the magazine 300 may include a processing device (not shown), such as the processing device 104, communicatively connected with the sensory device configured for analyzing the sensory data to generate an ammunition data. Further, the ammunition data may include a number of ammunition rounds in the magazine 300.

Further, the magazine 300 may include a presentation device 302 communicatively connected with the processing device configured for presenting the ammunition data.

Further, the magazine 300 may include a storage device (not shown), such as the processing device 108, configured for storing the ammunition data.

Further, in some embodiments, the sensory device may be positioned at feed lips of the magazine 300. Further, the sensory data may relate to an insertion of one or more ammunition rounds into the magazine 300.

Further, in some embodiments, the magazine 300 may be configured for feeding the ammunition to at least one of a shotgun, a rifle, a pistol, a machine gun, and a submachine gun.

Further, in some embodiments, the processing device may be configured for analyzing the sensory data for generating an ammunition usage data may include a usage of one or more rounds of ammunition.

Further, in some embodiments, the sensory device may include a location sensor. Further, the sensory data may include a location data. Further, the processing device may be configured for generating the ammunition usage data based on the location data. Further, the storage device may be configured for storing the ammunition usage data along with the location data.

Further, in some embodiments, the magazine 300 may include at least one actuator configured to interact with a firing mechanism of the firearm. Further, the processing device may be configured for generating an actuating signal based on the location data. Further, the at least one actuator may be configured to control the firing mechanism of the firearm based on the actuating signal.

Further, in some embodiments, the processing device may be configured for updating the ammunition data based on the sensory data. Further, the presentation device 302 may be configured for presenting the ammunition data based on the updating.

Further, in some embodiments, the presentation device 302 may include a digital display device configured to display the ammunition data. Further, in some embodiments, the magazine 300 may include an input mechanism configured for receiving a user input corresponding to a desired ammunition data. Further, the processing device may be configured for updating the desired ammunition data based on the sensory data to generate an updated ammunition data. Further, the presentation device 302 may be configured for displaying each of the desired ammunition data and the updated ammunition data respectively.

Further, in some embodiments, the magazine 300 may include at least one actuator configured to interact with a firing mechanism of the firearm. Further, the processing device may be configured for generating an actuating signal based on each of the desired ammunition data and the updated ammunition data. Further, the at least one actuator may be configured to control the firing mechanism of the firearm based on the actuating signal.

Figure 4:
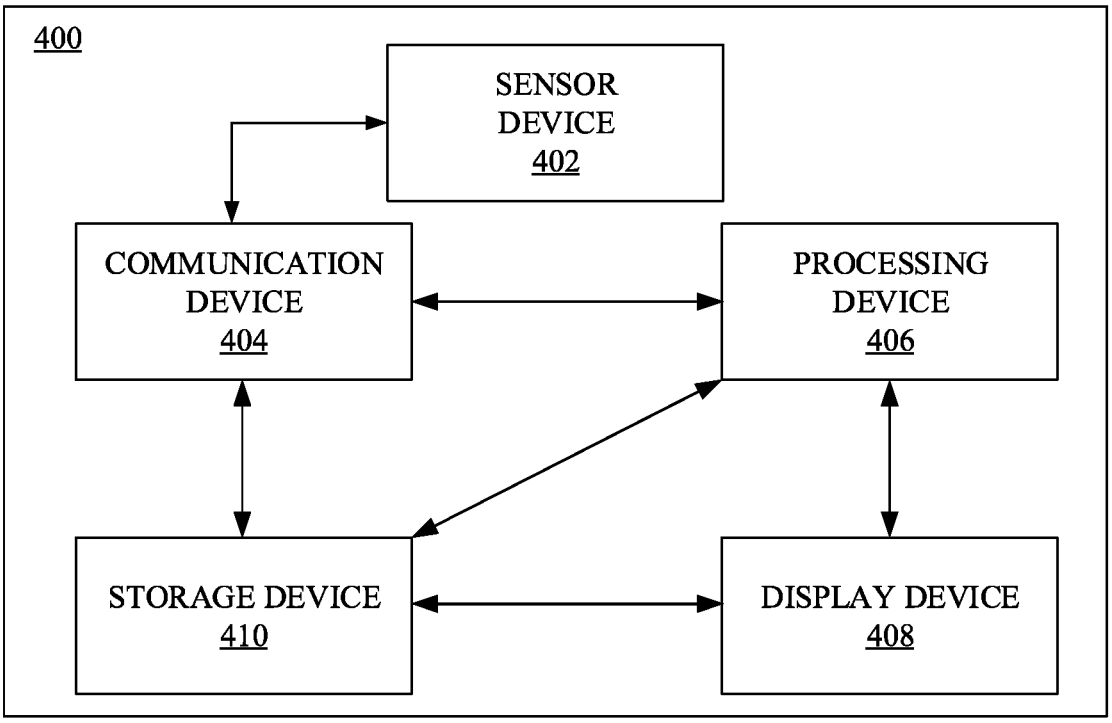
FIG. 4 is a block diagram of a system to facilitate counting and displaying remaining ammunition in a magazine of a firearm to a user, in accordance with some embodiments.

FIG. 4 is a block diagram of a system 400 to facilitate counting and displaying remaining ammunition in a magazine of a firearm to a user, in accordance with some embodiments. Further, the system 400 may be housed on the magazine of a firearm, such as magazine 1518.

Further, the system 400 may include a sensor device 402, a communication device 404, a processing device 406, a display device 408, and a storage device 410. Further, the sensor device 402 may include one or more sensors such as sensors 1516, infra-red sensors, photoelectric sensors, electro-optical sensors, laser sensors, etc. Moreover, the sensor device 402 may be located on feed lips of a magazine of a firearm. Further, the sensor device 402 may detect movement of an ammunition in the magazine of a firearm and out of the magazine of the firearm. For instance, while loading up an empty magazine of a firearm with ammunition, the sensor device 402 may count the ammunition loaded in the magazine of the firearm.

Further, the processing device 406 may generate an ammunition data. For instance, the ammunition data may include a number, wherein the number represents the ammunition loaded in the magazine of the firearm. Further, an ammunition usage data may represent the number of ammunition utilized to neutralize a potential target.

Further, the processing device 406 may transmit, using the communication device 404, the ammunition data as well as the ammunition usage data to the storage device 410.

Further, the storage device 410 may store the ammunition data as well as the ammunition usage data.

Further, when a shot is fired from a firearm then a slide moves an ammunition from the magazine of the firearm into the firearm. Further, the sensor device 402 may detect movement of the ammunition from the magazine into the firearm. For example, the sensor device 402 such as an infra-red sensor may detect movement of an ammunition from the magazine to the firearm.

Further, the communication device 404 may transmit the detected movement sensed by the sensor device 402 to the processing device 406.

Further, the processing device 406 may analyze and determine an updated ammunition data. For instance, the updated ammunition data may include a number, wherein the number may represent remaining ammunition in a magazine of a firearm. For example, the processing device 406 may retrieve the ammunition usage data stored in the storage device 410. Further, the processing device 406 may calculate the updated ammunition data. For instance, an ammunition data for a firearm may initially be 100. Further, a user may fire 10 shots using the firearm. Further, the processing device 406 may analyze the number of shots fired from the firearm. Further, the processing device 406 may determine the updated ammunition data herein 90 ammunitions based on the analysis.

Further, the processing device 406 may transmit the updated ammunition data to the display device 408.

Further, the display device 408 may display the updated ammunition data on the magazine of the firearm. For instance, the display device 408 may include one or more seven-segment displays to display the updated ammunition data.

Further, the storage device 410 may store the updated ammunition data.

In some embodiments, the ammunition remaining in a magazine of a firearm may be determined using detents 502. For instance, detents 502 may be embedded in a magazine of a firearm. Further, while loading the magazine of the firearm with ammunition, the detents 502 may retract and move in an outward direction. For example, when each ammunition moves through one or more detents 502, then the one or more detents 502 may be pushed in an outward direction. Further, a user may determine the ammunition remaining in the magazine of the firearm by feeling the one or more detents 502 pushed outwards.

In some embodiments, the updated ammunition data may be transmitted to a braille display located on the grip of a firearm. For instance, a braille display may be embedded in the grip of a firearm to assist a user in determining an updated ammunition data. For example, a user may be interested to know an updated ammunition data while shooting from a firearm in a darker environment wherein visible light may not be available. In such a case, the user may determine the updated ammunition data of the firearm by using a braille display that may be embedded on the grip of the firearm.

In some embodiments, a speaker may be integrated into a firearm that may notify a user with an updated ammunition data. For instance, the speaker may be embedded within the firearm and may receive, using the communication device 404, the updated ammunition data from the processing device 406. Further, the speaker may produce sound based on the received updated ammunition data and may notify the user.

In some embodiments, an updated ammunition data may be transmitted to a sighting device attached to a firearm. For instance, a user using a long-ranged firearm such as a sniper rifle may be notified with an updated ammunition data on a sighting device such as scope that may be attached to the sniper rifle. Further, users using Head-Up Display (HUD) may receive the updated ammunition data on the HUD.

In an exemplary embodiment, a user may receive haptic feedback for a firearm based on an updated ammunition data. For instance, a user may reach a critical ammunition limit that may be set by the user while shooting from a firearm. In such a case, the user may receive a haptic feedback from the firearm that may notify the user to reload the firearm.

In some embodiments, the rate at which a firearm may fire may be based on ammunition remaining in the magazine of the firearm. For instance, a user may set a threshold limit after which rate of firing may change automatically. For example, the rate of firing may switch when the user reaches the threshold limit to prevent wastage of ammunition. Further, the user may also be notified that ammunition remaining in the magazine of the firearm is low. For example, a firearm may automatically switch from fully automatic firing mode to burst fire mode, when ammunition remaining in the magazine of the firearm is low in number.

In some embodiments, the sensor device 402 may identify one or more types of ammunition in a magazine of a firearm and may display the identified one or more types of ammunition on the display device 408. For instance, the one or more types of ammunition may include non-lethal projectiles, explosive darts, tranquilizers etc.

In some embodiments, the sensor device 402 may include a Global Positioning System (GPS) tracker. Further, the GPS tracker may provide a location data and a time data at which a shot is fired from the firearm. Moreover, the location data and the time data may be stored in a storage device 410. Further, the location data and the time data may be utilized for analysis.

In some embodiments, a magazine of a firearm may be disabled if the location of the firearm is found to be in an unauthorized shooting zone. For instance, location and authorization of a user may be analyzed. Further, if analysis provides a positive result, then a magazine of a firearm may feed ammunition to the firearm. However, if analysis provides a negative result, then the magazine of the firearm may not feed ammunition to the firearm. For example, unauthorized personals such as a civilian-owned firearm may be disabled in the vicinity of an educational institution, such as a school or university. However, firearms owned by authorized personals such as security guards may function as usual.

Figure 5:
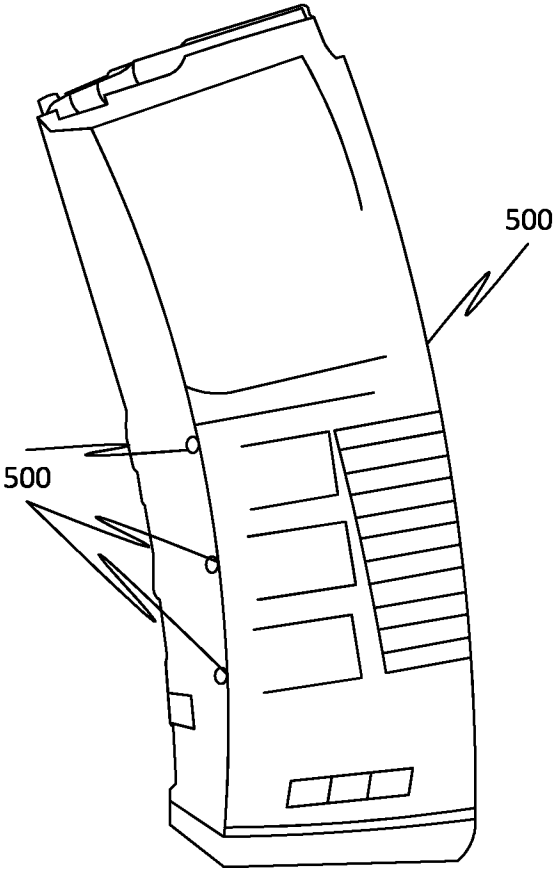
FIG. 5 is perspective front view of a magazine that may count and display ammunition data to a user, in accordance with some embodiments.
Figure 6:
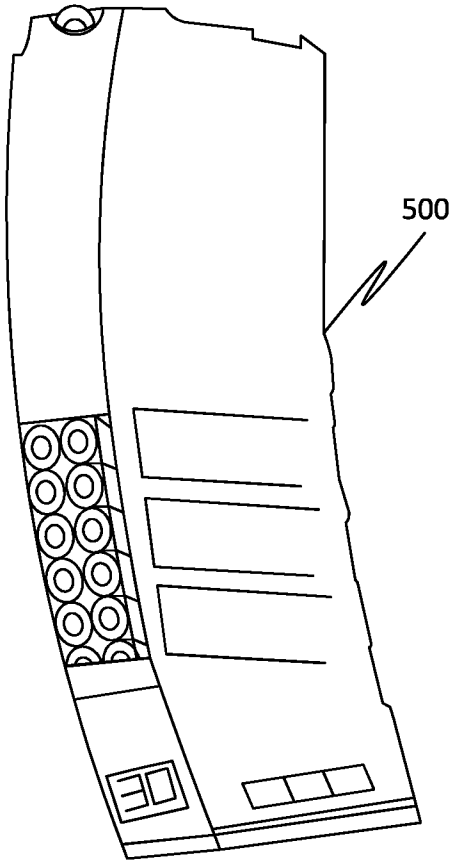
FIG. 6 is a perspective side view of the magazine that may count and display ammunition data to a user, in accordance with some embodiments.

FIG. 5 is perspective front view of a magazine 500 that may count and display ammunition data to a user, in accordance with some embodiments. FIG. 6 is a perspective side view of the magazine 500 that may count and display ammunition data to a user, in accordance with some embodiments. For instance, the ammunition data may be a number that may denote the number of remaining ammunition in a magazine of a firearm.

Figure 7:
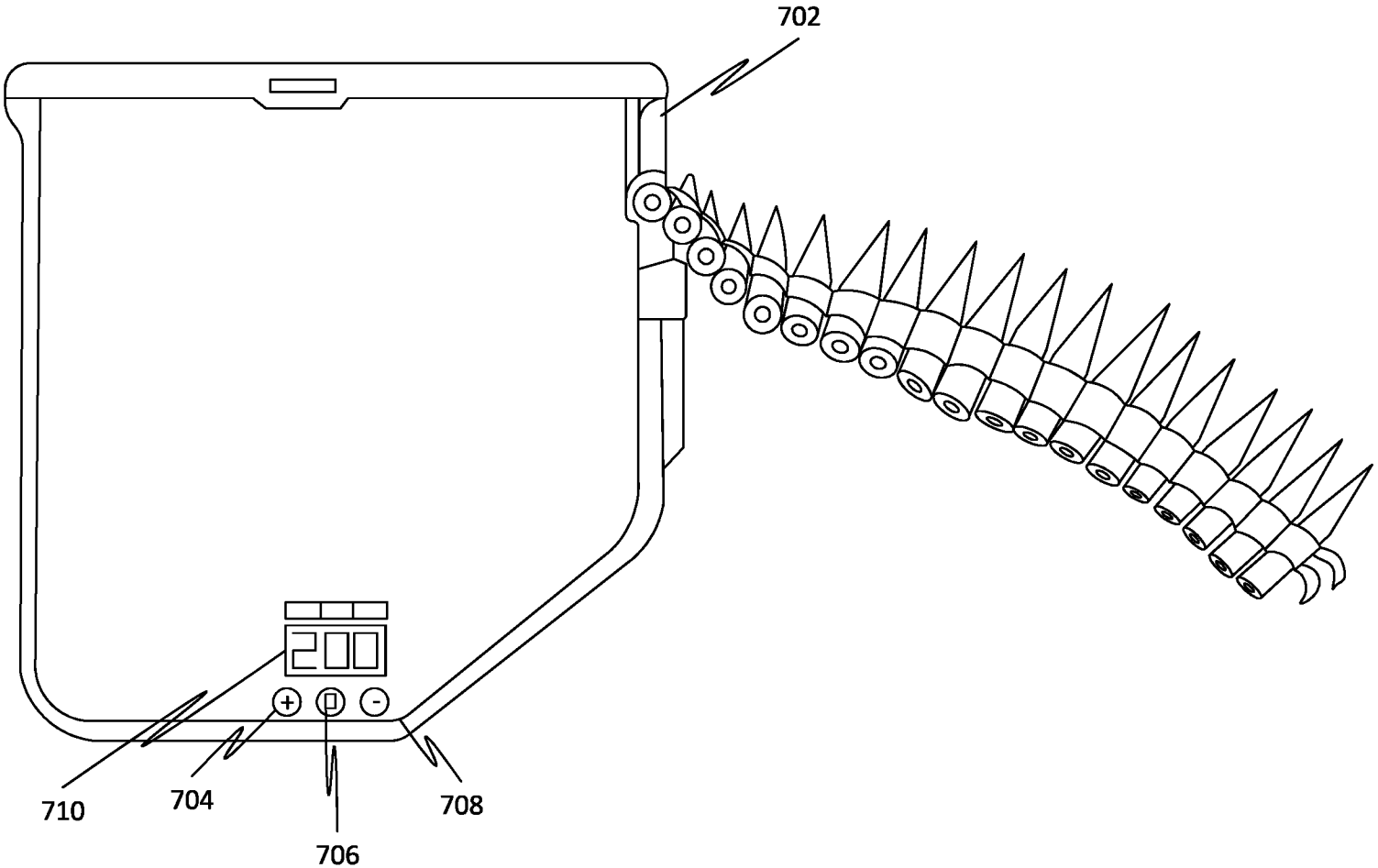
FIG. 7 is perspective view of a magazine that may count and display ammunition data to a user using a sensor, in accordance with some embodiments.

Further, the magazine 500 may be embedded with a sensor 702, such as an infra-red sensor, a photoelectric sensor, an electro-optical sensor, a laser sensor, etc. as illustrated in FIG. 7. Further, the sensor 702 may detect movement of an ammunition from the magazine to the firearm. Moreover, an updated ammunition data may be generated from the detected movement of the ammunition. For instance, the updated ammunition data may include a number that may represent remaining ammunition in a magazine of a firearm.

Further, the magazine 500 may be embedded with one or more buttons. For instance, the one or more buttons may include an add count button 704, a select button 706, and a decrease count button 708. Further, the select button 706 may be utilized to select a predetermined ammunition usage data. For instance, when an ammunition belt is utilized to feed ammunition, a user may enter a predetermined ammunition usage value. Further, the predetermined ammunition usage value may be a number, wherein the number may represent the ammunition required by a user at a moment.

Further, the add count 704 button may add number of ammunition to a predetermined ammunition usage data. For instance, a user may realize that more ammunition is required at a moment. Therefore, the user may utilize the add count 704 button to add number of ammunition to predetermined ammunition usage data.

Further, the decrease count 708 button may decrease number of ammunition from a predetermined ammunition usage data. For instance, a user may realize that less ammunition is required at a moment. Therefore, the user may utilize the decrease count button 708 to decrease number of ammunition from predetermined ammunition usage data.

Further, the magazine 500 may be embedded with a digital display such as an LED display 710.

Figure 8:
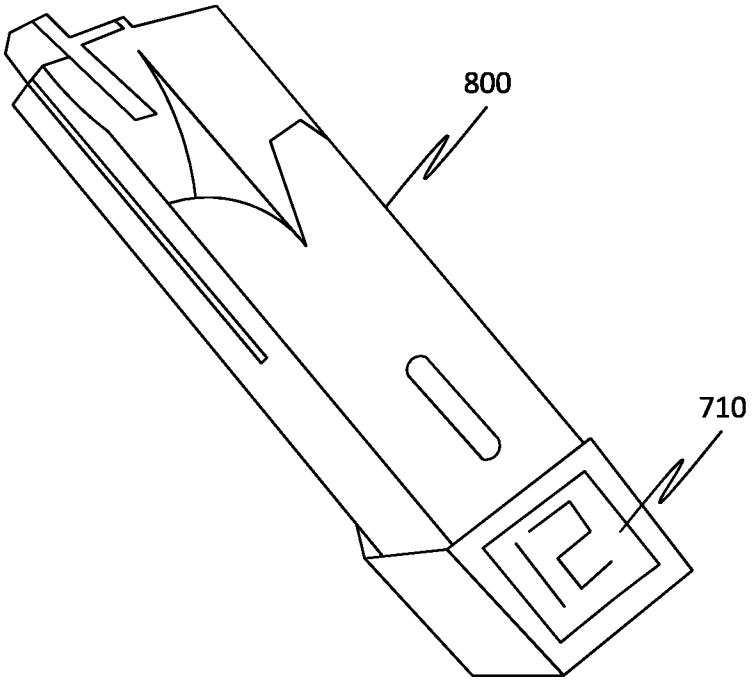
FIG. 8 is a representation of a magazine of a handgun including an LED display, in accordance with some embodiments.

FIG. 8 is a representation of a magazine 800 of handgun including the LED display 710. Further, in an instance, the digital display 710 may be a waterproof and dustproof display that may display the updated ammunition data.

Figure 9:
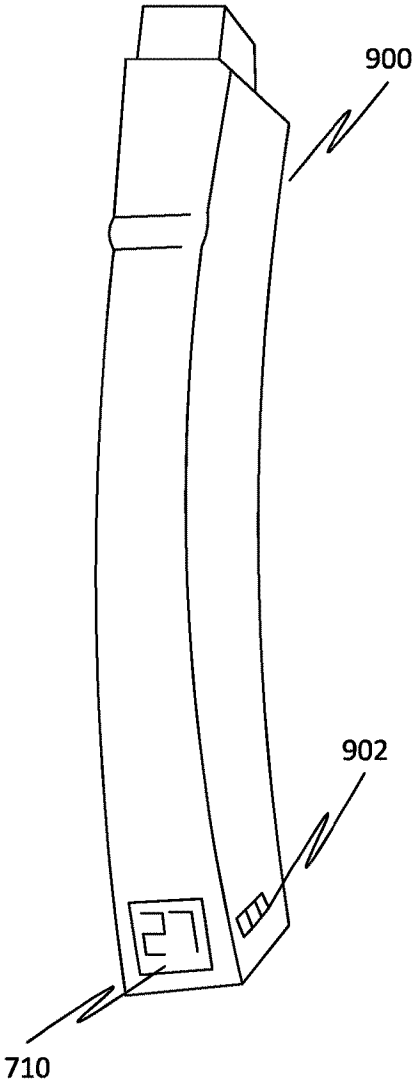
FIG. 9 is a magazine of a handgun including a colored display to notify a user with the updated ammunition data, in accordance with some embodiments.

FIG. 9 is a magazine 900 of a handgun including the LED display 710, and a colored display 902 embedded on the magazine 900 to notify a user with the updated ammunition data. For instance, the colored display 902 may include one or more colors such as red, amber, and green etc. Further, illumination of the one or more colors may determine different ammunition data as illustrated in FIG. 7. For example, the magazine 900 may store 30 ammunition rounds at a moment, then illumination of green color may signify that the magazine 900 may be full. Moreover, illumination of amber color may signify that remaining ammunition in the magazine 900 may be in between 15 to 30. Further, illumination of red color may signify that remaining ammunition in the magazine 900 may be less than 5.

Figure 10:
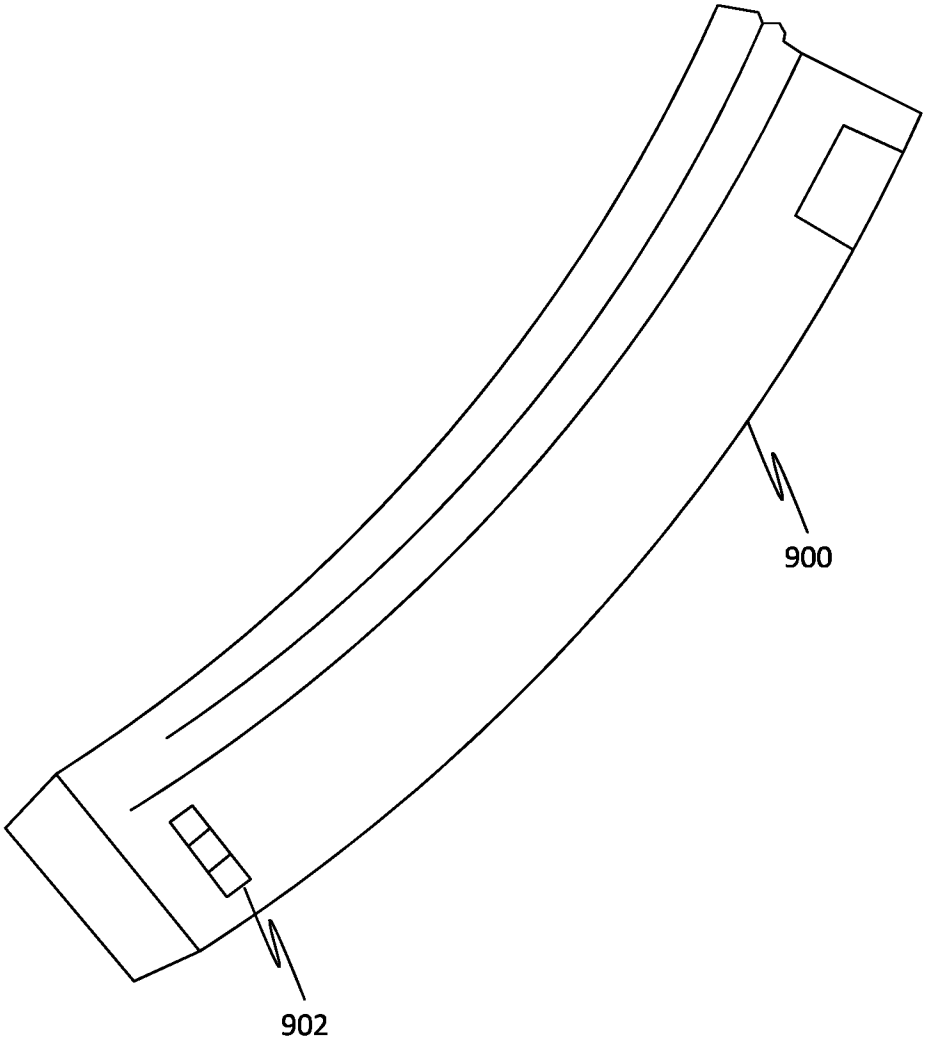
FIG. 10 is a side view of the magazine a handgun including a colored display, in accordance with some embodiments.

FIG. 10 is a side view of the magazine 900, in accordance with some embodiments.

Figure 11:
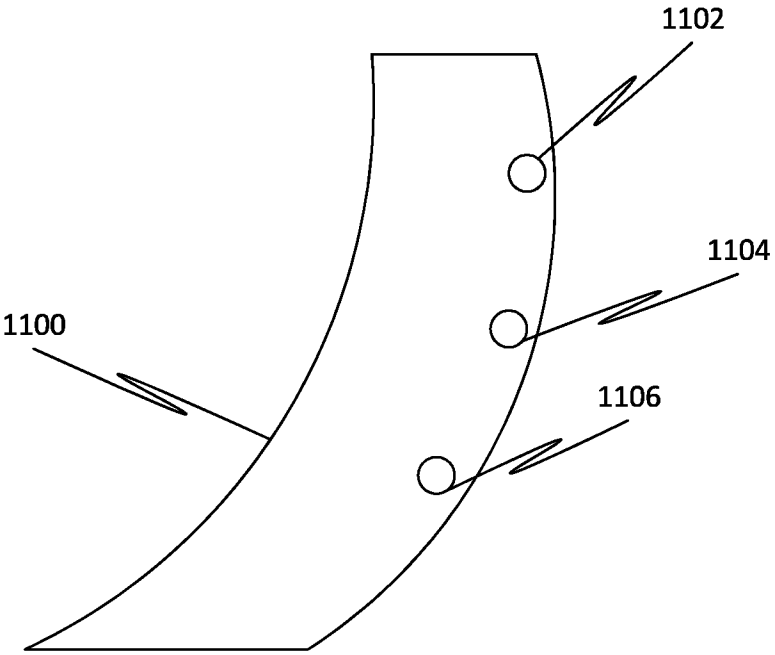
FIG. 11 is an exemplary illustration of a magazine for counting and notifying an ammunition data to a user, in accordance with some embodiments.

FIG. 11 is an exemplary illustration of a magazine 1100 for counting and notifying an ammunition data to a user, in accordance with some embodiments. For instance, the ammunition data may represent ammunition remaining in the magazine 1100. Further, the magazine 1100 may include one or more Light Emitting Diodes (LEDs), such as a Red LED 1102, a yellow/amber LED 1104, and a green LED 1106. Further, illumination of the one or more LEDs may determine different ammunition data. For example, a magazine 1100 may store 30 ammunitions at a moment, then illumination of the green LED 1106 may signify that the magazine 1100 is full. Moreover, illumination of the yellow/amber LED 1104 may signify that remaining ammunition in the magazine 1100 are in between 15 to 30. Further, illumination of the red LED 1102 may signify that remaining ammunition in the magazine 1100 are less than 5.

Figure 12:
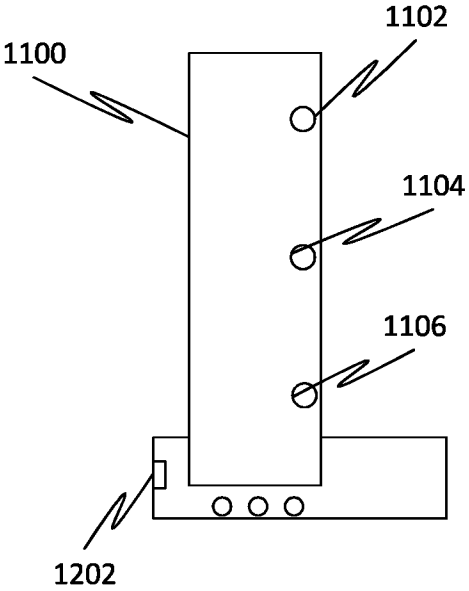
FIG. 12 is an exemplary illustration of a magazine for counting and notifying an ammunition data to a user including an IR emitter, in accordance with some embodiments.
Figure 13:
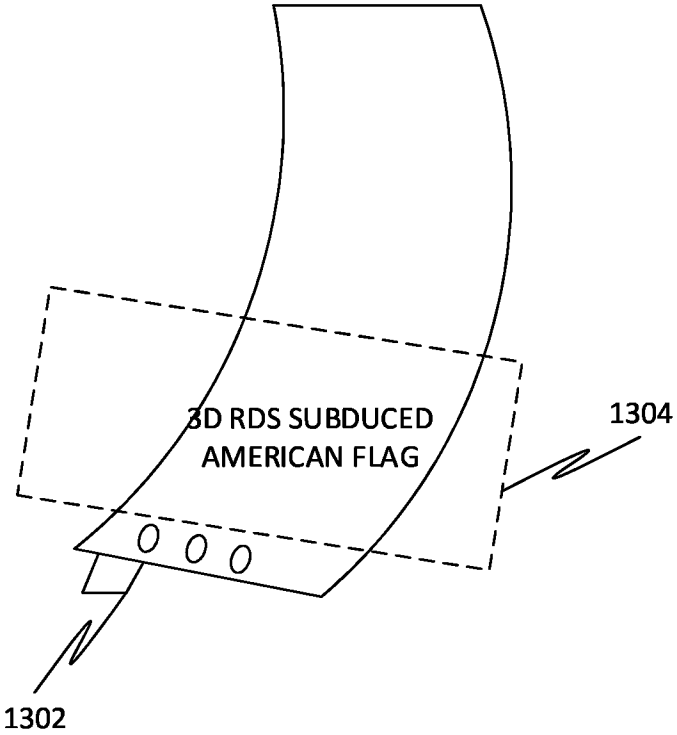
FIG. 13 is an exemplary illustration of a magazine for counting and notifying an ammunition data to a user including an IR button, in accordance with some embodiments.
Figure 14:
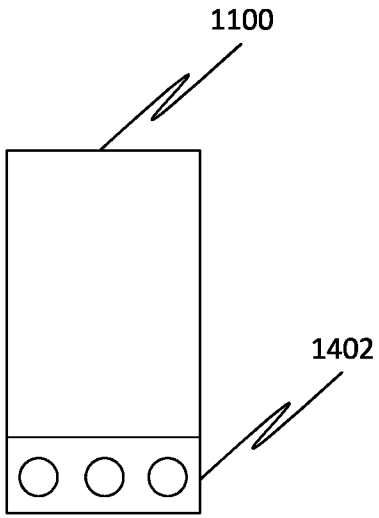
FIG. 14 is an exemplary illustration of a magazine for counting and notifying an ammunition data to a user including a power source, in accordance with some embodiments.

Further, the magazine 1100 may be embedded with an IR emitter 1202 as illustrated in FIG. 12. For instance, a user may press an IR button 1302 that may be located on the magazine 1100 as illustrated in FIG. 13. Further, the IR emitter 1202 may emit IR light. For example, a user using a firearm with IR emitter 1202 along with a night vision device may be able to view a target clearly while approaching in total darkness. Further, the magazine 1100 may be incorporated with a sleeve, including at least one graphic, such as a flag, to increase a visual appeal of the magazine 1100. Further, the magazine 1100 may include at least one power source 1402, such as a battery provide power to the IR emitter 1202 as illustrated in FIG. 14.

Figure 15:
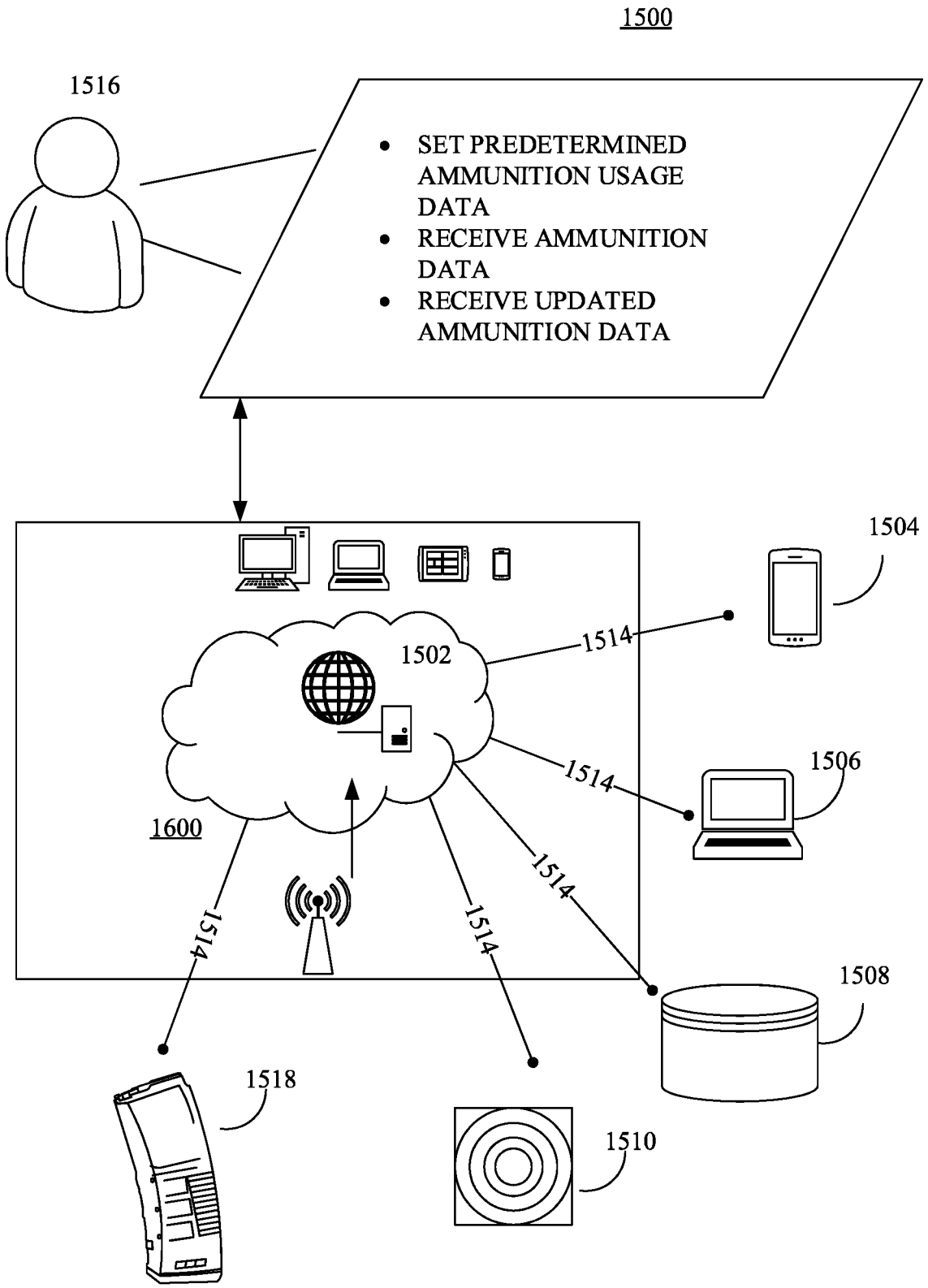
FIG. 15 is an illustration of an online platform consistent with various embodiments of the present disclosure

FIG. 15 is an illustration of an online platform 1500 consistent with various embodiments of the present disclosure. By way of non-limiting example, the online platform 1500 to facilitate counting and displaying of an ammunition count of a magazine of a firearm may be hosted on a centralized server 1502, such as, for example, a cloud computing service. The centralized server 1502 may communicate with other network entities, such as, for example, a mobile device 1504 (such as a smartphone, a laptop, a tablet computer etc.), other electronic devices 1506 (such as desktop computers, server computers etc.), databases 1508, sensors 1510, actuators (not shown), and a magazine 1518 of a firearm over a communication network 1514, such as, but not limited to, the Internet. Further, users of the online platform 1500 may include relevant parties such as, but not limited to, end users, administrators, service providers, service consumers and so on. Accordingly, in some instances, electronic devices operated by the one or more relevant parties may be in communication with the platform.

A user 1516, such as the one or more relevant parties, may access online platform 1500 through a web based software application or browser. The web based software application may be embodied as, for example, but not be limited to, a website, a web application, a desktop application, and a mobile application compatible with a computing device 1600.

Figure 16:
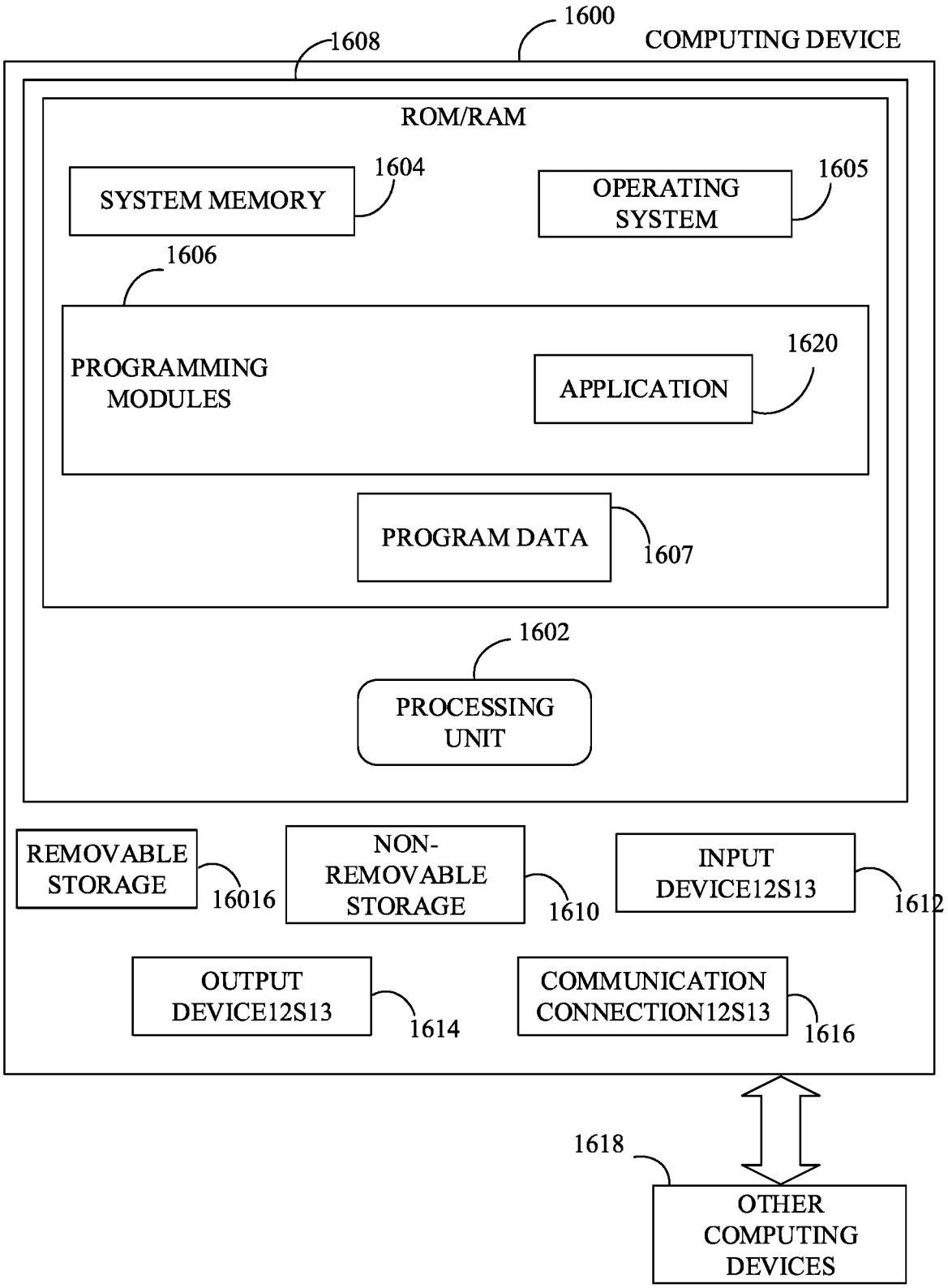
FIG. 16 is a block diagram of a computing device for implementing the methods disclosed herein, in accordance with some embodiments.

With reference to FIG. 16, a system consistent with an embodiment of the disclosure may include a computing device or cloud service, such as computing device 1600. In a basic configuration, computing device 1600 may include at least one processing unit 1602 and a system memory 1604. Depending on the configuration and type of computing device, system memory 1604 may comprise, but is not limited to, volatile (e.g. random-access memory (RAM)), non-volatile (e.g. read-only memory (ROM)), flash memory, or any combination. System memory 1604 may include operating system 1605, one or more programming modules 1606, and may include a program data 1607. Operating system 1605, for example, may be suitable for controlling computing device 1600's operation. In one embodiment, programming modules 1606 may include image-processing module, machine learning module. Furthermore, embodiments of the disclosure may be practiced in conjunction with a graphics library, other operating systems, or any other application program and is not limited to any particular application or system. This basic configuration is illustrated in FIG. 16 by those components within a dashed line 1608.

Computing device 1600 may have additional features or functionality. For example, computing device 1600 may also include additional data storage devices (removable and/or non-removable) such as, for example, magnetic disks, optical disks, or tape. Such additional storage is illustrated in FIG. 16 by a removable storage 1609 and a non-removable storage 1610. Computer storage media may include volatile and non-volatile, removable and non-removable media implemented in any method or technology for storage of information, such as computer-readable instructions, data structures, program modules, or other data. System memory 1604, removable storage 1609, and non-removable storage 1610 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 1600. Any such computer storage media may be part of device 1600. Computing device 1600 may also have input device(s) 1612 such as a keyboard, a mouse, a pen, a sound input device, a touch input device, a location sensor, a camera, a biometric sensor, etc. Output device(s) 1614 such as a display, speakers, a printer, etc. may also be included. The aforementioned devices are examples and others may be used.

Computing device 1600 may also contain a communication connection 1616 that may allow device 1600 to communicate with other computing devices 1618, such as over a network in a distributed computing environment, for example, an intranet or the Internet. Communication connection 1616 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both storage media and communication media.

As stated above, a number of program modules and data files may be stored in system memory 1604, including operating system 1605. While executing on processing unit 1602, programming modules 1606 (e.g., application 1620 such as a media player) may perform processes including, for example, one or more stages of methods, algorithms, systems, applications, servers, databases as described above. The aforementioned process is an example, and processing unit 1602 may perform other processes. Other programming modules that may be used in accordance with embodiments of the present disclosure may include machine learning applications.

Generally, consistent with embodiments of the disclosure, program modules may include routines, programs, components, data structures, and other types of structures that may perform particular tasks or that may implement particular abstract data types. Moreover, embodiments of the disclosure may be practiced with other computer system configurations, including hand-held devices, general purpose graphics processor-based systems, multiprocessor systems, microprocessor-based or programmable consumer electronics, application specific integrated circuit-based electronics, minicomputers, mainframe computers, and the like. Embodiments of the disclosure may also be practiced in distributed computing environments where tasks are performed by remote processing devices that are linked through a communications network. In a distributed computing environment, program modules may be located in both local and remote memory storage devices.

Furthermore, embodiments of the disclosure may be practiced in an electrical circuit comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, embodiments of the disclosure may be practiced within a general-purpose computer or in any other circuits or systems.

Embodiments of the disclosure, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present disclosure may be embodied in hardware and/or in software (including firmware, resident software, micro-code, etc.). In other words, embodiments of the present disclosure may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random-access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Furthermore, although embodiments of the present disclosure have been described as being associated with data stored in memory and other storage mediums, data can also be stored on or read from other types of computer-readable media, such as secondary storage devices, like hard disks, solid state storage (e.g., USB drive), or a CD-ROM, a carrier wave from the Internet, or other forms of RAM or ROM. Further, the disclosed methods' stages may be modified in any manner, including by reordering stages and/or inserting or deleting stages, without departing from the disclosure.

Although the present disclosure has been explained in relation to its preferred embodiment, it is to be understood that many other possible modifications and variations can be made without departing from the spirit and scope of the disclosure.

What is claimed is:

1. A system to facilitate counting and displaying of an ammunition count of a magazine of a firearm, the system comprising:

a sensory device configured to generate a sensory data related to a movement of ammunition in the magazine;

a processing device communicatively connected with the sensory device configured for analyzing the sensory data to generate an ammunition data, wherein the ammunition data comprises a number of ammunition rounds in the magazine;

a presentation device communicatively connected with the processing device configured for presenting the ammunition data;

a storage device configured for storing the ammunition data;

the sensory device is positioned at feed lips of the magazine;

the sensory data relates to an insertion of one or more ammunition rounds into the magazine; and the sensory device comprising at least one of an infrared sensor, a photoelectric sensor, an electro-optical sensor and a laser sensor.

2. The system of claim 1, wherein the sensory data relates to a movement of the ammunition from the magazine to a firing chamber of the firearm.

3. The system of claim 2, wherein the processing device is configured for analysing the sensory data for generating an ammunition usage data comprising a usage of one or more rounds of ammunition.

4. The system of claim 3, wherein the sensory device comprises a location sensor, wherein the sensory data comprises a location data, wherein the processing device is further configured for generating the ammunition usage data based on the location data, wherein the storage device is configured for storing the ammunition usage data along with the location data.

5. The system of claim 4 further comprising at least one actuator configured to interact with a firing mechanism of the firearm, wherein the processing device is configured for generating an actuating signal based on the location data, wherein the at least one actuator is configured to control the firing mechanism of the firearm based on the actuating signal.

6. The system of claim 1, wherein the processing device is configured for updating the ammunition data based on the sensory data, wherein the presentation device is configured for presenting the ammunition data based on the updating.

7. The system of claim 1, wherein the presentation device comprises a digital display device configured to display the ammunition data.

8. The system of claim 1 further comprising an input mechanism configured for receiving a user input corresponding to a desired ammunition data, wherein the processing device is further configured for updating the desired ammunition data based on the sensory data to generate an updated ammunition data, wherein the presentation device is further configured for presenting each of the desired ammunition data and the updated ammunition data respectively.

9. The system of claim 8 further comprising at least one actuator configured to interact with a firing mechanism of the firearm, wherein the processing device is configured for generating an actuating signal based on each of the desired ammunition data and the updated ammunition data, wherein the at least one actuator is configured to control the firing mechanism of the firearm based on the actuating signal.

10. A magazine of a firearm configured for counting and displaying of an ammunition count of the magazine, the magazine comprising:

a sensory device configured to generate a sensory data related to at least one of a movement of ammunition in the magazine, and a movement of the ammunition from the magazine to a firing chamber of the firearm;

a processing device communicatively connected with the sensory device configured for analyzing the sensory data to generate an ammunition data, wherein the ammunition data comprises a number of ammunition rounds in the magazine;

a presentation device communicatively connected with the processing device configured for presenting the ammunition data;

a storage device configured for storing the ammunition data;

the sensory device is positioned at feed lips of the magazine;

the sensory data relates to an insertion of one or more ammunition rounds into the magazine; and the sensory device comprising at least one of an infrared sensor, a photoelectric sensor, an electro-optical sensor and a laser sensor.

11. The magazine of claim 10, wherein the magazine is configured for feeding the ammunition to at least one of a shotgun, a rifle, a pistol, a machine gun, and a submachine gun.

12. The magazine of claim 10, wherein the processing device is configured for analysing the sensory data for generating an ammunition usage data comprising a usage of one or more rounds of ammunition.

13. The magazine of claim 12, wherein the sensory device comprises a location sensor, wherein the sensory data comprises a location data, wherein the processing device is further configured for generating the ammunition usage data based on the location data, wherein the storage device is configured for storing the ammunition usage data along with the location data.

14. The magazine of claim 13 further comprising at least one actuator configured to interact with a firing mechanism of the firearm, wherein the processing device is configured for generating an actuating signal based on the location data, wherein the at least one actuator is configured to control the firing mechanism of the firearm based on the actuating signal.

15. The magazine of claim 10, wherein the processing device is configured for updating the ammunition data based on the sensory data, wherein the presentation device is configured for presenting the ammunition data based on the updating.

16. The magazine of claim 10, wherein the presentation device comprises a digital display device configured to display the ammunition data.

17. The magazine of claim 10 further comprising an input mechanism configured for receiving a user input corresponding to a desired ammunition data, wherein the processing device is further configured for updating the desired ammunition data based on the sensory data to generate an updated ammunition data, wherein the presentation device is further configured for presenting each of the desired ammunition data and the updated ammunition data respectively.

18. The magazine of claim 17 further comprising at least one actuator configured to interact with a firing mechanism of the firearm, wherein the processing device is configured for generating an actuating signal based on each of the desired ammunition data and the updated ammunition data, wherein the at least one actuator is configured to control the firing mechanism of the firearm based on the actuating signal.

* * * * *